US006806467B1

(12) United States Patent
Funsten et al.

(10) Patent No.: US 6,806,467 B1
(45) Date of Patent: Oct. 19, 2004

(54) CONTINUOUS TIME-OF-FLIGHT ION MASS SPECTROMETER

(75) Inventors: Herbert O. Funsten, Los Alamos, NM (US); William C. Feldman, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/625,935

(22) Filed: Jul. 24, 2003

(51) Int. Cl.[7] ..... H01J 49/00
(52) U.S. Cl. ..... 250/287; 250/423 R
(58) Field of Search ..... 250/287

(56) References Cited

U.S. PATENT DOCUMENTS 6,545,269 B1 * 4/2003 Pierrejean et al. ..... 250/288

FOREIGN PATENT DOCUMENTS

JP 02000348665 A * 12/2000

* cited by examiner

*Primary Examiner*—John R. Lee
*Assistant Examiner*—James J. Leybourne
(74) *Attorney, Agent, or Firm*—Milton D. Wyrick

(57) ABSTRACT

A continuous time-of-flight mass spectrometer having an evacuated enclosure with means for generating an electric field located in the evacuated enclosure and means for injecting a sample material into the electric field. A source of continuous ionizing radiation injects ionizing radiation into the electric field to ionize atoms or molecules of the sample material, and timing means determine the time elapsed between arrival of a secondary electron out of said ionized atoms or molecules at a first predetermined location and arrival of a sample ion out of said ionized atoms or molecules at a second predetermined location.

21 Claims, 4 Drawing Sheets

Key:
● = neutral sample atom or molecule
⊕ = positively ionized neutral atom or molecule of sample
ⓔ = secondary electron associated with ionization event
$z$ = distance from "stop" detector (parallel to the central axis of the drift region)
$d$ = distance ion travels in drift region
$V_1$ = voltage at "Stop" end of the drift tube
$V_2$ = voltage at opposite end of drift tube ($V_1 < V_2$)

CONTINUOUS TIME-OF-FLIGHT ION MASS SPECTROMETER

FIELD OF THE INVENTION

The present invention generally relates to mass spectrometers, and, more specifically, relates to a time-of-flight ion mass spectrometer that can operate continuously. This invention was made with Government support under Contract No. W-7405-ENG-36 awarded by the U.S. Department of Energy. The Government has certain rights in the invention.

BACKGROUND OF THE INVENTION

Mass spectrometers are used extensively in the scientific community to measure and analyze the chemical compositions of substances. In general, a mass spectrometer is made up of a source of ions that are used to ionize neutral atoms or molecules from a solid, liquid or gaseous substance, a mass analyzer that separates the ions in space or time according to their mass or their mass-per-charge ratio, and a detector. Several variations of mass spectrometers are available, such as magnetic sector mass spectrometers, quadrupole mass spectrometers, and time-of-flight mass spectrometers.

The magnetic sector mass spectrometer uses a magnetic field or combined magnetic and electrostatic fields to measure the ion mass-per-charge ratio. In one type of magnetic sector geometry, {see A. O. Nier, *Review of Scientific Instruments*, Vol. 18 (1947) p. 398; L. Holmlid, *International Journal of Mass Spectrometry and Ion Physics*, Vol. 17 (1975) p. 403} only one mass-per-charge species is detected at any one time, so the magnetic field strength and, if present, the electric field strength must be varied in order to obtain a mass spectrum comprising multiple mass-per-charge species. Major limitations on this type of mass spectrometer are the high mass of the magnet and the time that is required to scan the entire mass range one mass at a time.

Another type of magnetic sector mass spectrometer creates a monoenergetic beam of ions, which are spatially dispersed according to mass-per-charge ratio, and which are focused onto an imaging plate {e.g., J. Mattauch and R. Herzog, *Zeitschrift fur Physik*, Vol. 89 (1934) p. 786}. While this type of spectrometer can detect multiple mass-per-charge species can be detected simultaneously, the poor spatial resolution it provides limits its use to a narrow mass range.

Quadrupole mass spectrometers utilize a mass filter having dynamic electric fields between four electrodes {e.g., *Quadrupole Mass Spectrometer and its Applications*, ed. Peter H. Dawson (American Institute of Physics, New York, 1995)}. These fields are tailored to allow only one mass-per-charge ion to pass through the filter at a time. Major limitations of quadrupole mass spectrometers are the high mass of mass of the required magnet and the time required to scan the entire mass range one mass at a time.

Time-of-flight mass spectrometers (TOFMS) can detect ions over a wide mass range simultaneously {see W. C. Wiley and I. H. McLaren, *Rev. Sci. Instrum.*, Vol. 26 (1955) p. 1150; M. Guilhaus, *J. Mass Spectrom.*, Vol. 30 (1995) p. 1519}. Mass spectra are derived by measuring the times for individual ions to traverse a known distance through an electrostatic field free region. In general, the mass of an ion is derived in TOFMS by measurement or knowledge of the energy, E, of an ion, measurement of the time, $t_1$, that an ion passes a fixed point in space, $P_1$, and measurement of the later time, $t_2$, that the ion passes a second point, $P_2$, in space located a distance, d, from $P_1$. Using an ion beam of known energy-per-charge E/q, the time-of-flight (TOF) of the ion is $t_{TOF}=t_2-t_1$, and by the ion speed is $v=d/t_{TOF}$. Since $E=0.5\,mv^2$, the ion mass-per-charge m/q is represented by the following equation:

$$\frac{m}{q}=\frac{2Et_{TOF}^2}{qd^2}. \tag{10}$$

The mass-per-charge resolution, commonly referred to as the mass resolving power of a mass spectrometer, is defined as:

$$\frac{\Delta m/q}{m/q}=\frac{\Delta E}{E}+2\frac{\Delta t_{TOF}}{t_{TOF}}+2\frac{\Delta d}{d}, \tag{11}$$

where $\Delta E$, $\Delta t_{TOF}$, and $\Delta d$ are the uncertainties in the knowledge or measurement of the ion's energy, E, time-of-flight, $t_{TOF}$, and distance of travel, d, respectively, in conventional time-of-flight spectrometers.

In a gated TOFMS in which a narrow bunch of ions is periodically injected into the drift region, uncertainty in $t_{TOF}$ may result, for example, from ambiguity in the exact time that an ion entered the drift region due to the finite time, $\Delta t_1$, that the gate is "open," i.e. $\Delta t_1 \approx \Delta t_{TOF}$. The ratio of $\Delta t_{TOF}/t_{TOF}$ can be minimized by decreasing $\Delta t_{TOF}$, for example, by decreasing the time the gate is "open." This ratio can also be minimized by increasing $t_{TOF}$, for example, by increasing the distance, d, that an ion travels in the drift region. Often, a reflectron device is used to increase the distance of travel without increasing the physical size of the drift region.

Uncertainty in the distance of travel, d, can arise if the ion beam has a slight angular divergence so that ions travel slightly different paths, and, therefore, slightly different distances to the detector. The ratio of $\Delta d/d$ can be minimized by employing a long drift region, a small detector, and a highly collimated ion beam.

The uncertainty in the ion energy, E, may result from the initial spread of energies, $\Delta E$, of ions emitted from the ion source. Therefore, ions are typically accelerated to an energy, E, that is much greater than $\Delta E$.

A further limitation of conventional mass spectrometry lies in the fact that the source of ions is a separate component from the time-of-flight section of a spectrometer, and it requires significant resources. First, most ion sources are inherently inefficient, so that few atoms or molecules of a gaseous sample are ionized, thereby requiring a large volume of sample and, in order to maintain a proper vacuum, a large vacuum pumping capacity. Second, the ion source typically generates a continuous ion beam that is gated periodically, creating an inefficient condition in which sample material and electrical energy are wasted during the time the gate is "closed." Third, ions have to be transported from the ion source to the time-of-flight section, requiring, among other things, electrostatic acceleration, steering and focusing. Fourth, typical ion sources introduce a significant spread in energy of the ions so that the ions must be substantially accelerated to minimize the effect of this energy spread on the mass resolving power. Finally, having an ion source separate from the drift region creates an apparatus having large mass and volume.

Still another problem with conventional time-of-flight mass spectrometers is that ions must be localized in space at time $t_1$ in order to minimize $\Delta d$ and therefore, minimize the mass resolving power. Typically, time $t_1$ corresponds to the time that the ion is located at the entrance to the drift region.

In addition to these limitations that impact the mass resolving power of prior art TOFMS, an important further limitation is the intrinsically low duty cycle associated with the gating process in which a group of ions briefly is admitted at time $t_1$ into the drift region. The time that must elapse before another group of ions can be admitted is determined by the time required for the heaviest, and therefore the slowest, ion, admitted at time $t_1$, to reach the detector. This generally long period is necessary to prevent overlap of mass spectra, which are accumulated each gating period. Although sophisticated techniques have been developed in attempts to improve this limitation, the duty cycle of prior art TOFMS is still much less than unity.

One method of attempting overcome this limitation in TOFMS utilizes a thin foil located at the entrance to the drift region. A sample ion having sufficient energy to traverse the foil will continue to the "stop" detector. Secondary electrons generated by the interaction of the sample ion with the foil are detected, and provide a measurement of the time $t_1$ that the ion entered the drift region. However, this method is not without its own limitations. These limitations include the requirement that the incident ion have sufficient energy to transit the foil, the energy degradation of the sample ion due to interaction with the foil, and the angular scattering of the sample ion due also to its interaction with the foil.

The present invention solves these problems of the prior art by continuously ionizing sample atoms or molecules that are initially at rest inside a drift region having an electric field. The secondary electron that is created by the ionization event is detected to provide the time $t_1$, and the detection of the ion at a "stop" detector provides the stop time $t_2$.

SUMMARY OF THE INVENTION

In order to achieve the objects and purposes of the present invention, and in accordance with its objectives, a time-of-flight ion mass spectrometer comprises an evacuated enclosure, with means for generating an electric field located in the evacuated enclosure, and means for injecting a sample material into the electric field. A source of continuous ionizing radiation injects ionizing radiation into the electric field to ionize atoms or molecules of the sample material, and timing means for determining time elapsed between arrival of a secondary electron having a particular energy out of the ionized atoms or molecules at a first predetermined location and arrival of a sample ion having a particular energy out of the ionized atoms or molecules at a second predetermined location.

BRIEF DESCRIPTION OF THE DRAWINGS

The accompanying drawing, which is incorporated in and forms a part of the specification, illustrates an embodiment of the present invention and, together with the description, serves to explain the principles of the invention. In the drawing.

DETAILED DESCRIPTION

Figure 1:
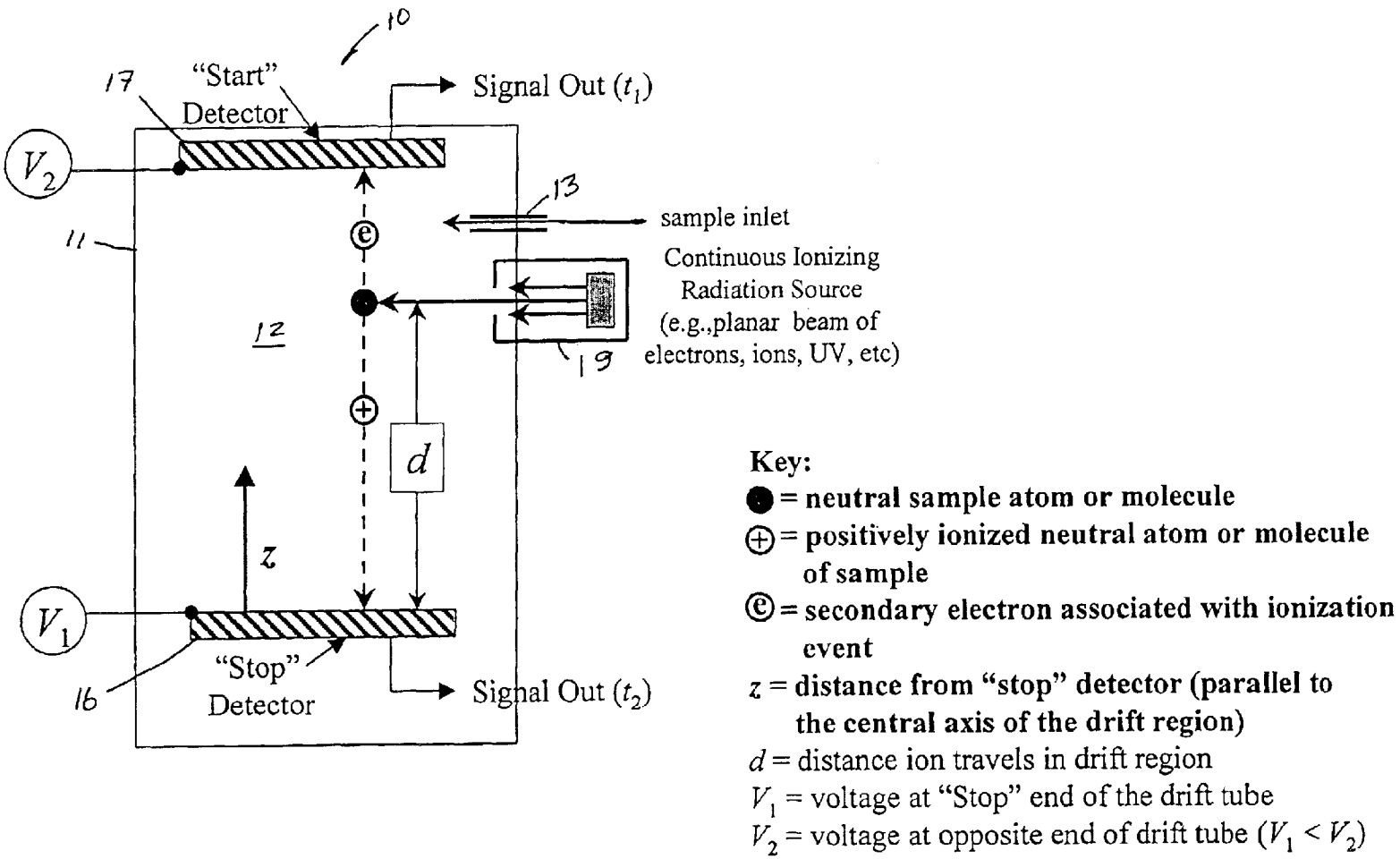
FIG. 1 is a schematic illustration of an embodiment of the present invention showing the elements of the invention and its operation with a static electric field.

The present invention continuously ionizes sample atoms or molecules within a drift region having an electric field of magnitude $\epsilon(z)$, aligned coaxially with the central z-axis of a drift region. The electric field accelerates the secondary electrons toward a first detector, and the generated ions toward a second detector. The invention provides high mass resolving power, smaller resource requirements in such areas as mass, power, volume, and pumping capacity, a high efficiency, since nearly every ionization event is detected, and elimination of the prior art requirement that the location of an ion at time $t_1$ must be known in order to measure its time-of-flight in the drift region. The invention can be understood more easily through reference to the drawing.

Referring to FIG. 1, there can be seen the time-of-flight mass spectrometer 10 of the present invention resides inside evacuated chamber 11. The gaseous sample to be investigated is introduced into drift region 12 by sample inlet 13. Alternatively, a solid sample could be introduced, for example, at the surface of an electrode placed in drift region 12. As shown, a static electric field exists between start detector 17 and stop detector 16 due to the difference in voltage between $V_1$ and $V_2$, with $V_1$ being negative with respect to $V_2$.

The general equation governing the motion of an ion in a static electric field is:

$$m\frac{d^2z}{dt^2} = q\varepsilon(z), \tag{12}$$

which can be solved analytically or numerically depending on the functional form of $\epsilon(z)$. For a sample ion initially at rest, the solution of Equation 11 provides the mass-per-charge of the sample ion if the time-of-flight, $t_{TOF}$, distance of travel, d, and electric field, $\epsilon(z)$, are known.

If the electric field created by the difference in potential between $V_1$ and $V_2$ is constant across the drift region, as it is in one embodiment of the present invention (i.e., $\epsilon(z)=\epsilon_0$), and the ionization event occurs at a known distance from stop detector 16, the mass-per-charge of an ion initially at rest is:

$$t_{TOF} = \left(\frac{2md}{q\varepsilon_0}\right)^{1/2}. \tag{13}$$

Under the initial conditions that stop detector 16 is located at z=0, and that the ion is created at rest at a distance of z=d from stop detector 16, the time-of-flight of the ion according to Equation 12 is:

$$\frac{m}{q} = \frac{\varepsilon_0 t_{TOF}^2}{2d}. \tag{14}$$

Knowledge of the distance of travel, d, generally requires that the ionization event occur at a fixed, known distance from stop detector 16. This can be achieved by using a continuous ionizing radiation source 19 whose ionizing particles are confined to a thin plane having a thickness, g, oriented perpendicular to the z-axis. However, the mass resolving power of the present invention is dependent on g/d, which can be minimized by minimizing g.

Continuous ionizing radiation source 19 ionizes sample atoms or molecules and creates a secondary electron that is accelerated to start detector where it is detected at time, $t_1$.

The ionized atom or molecule also is accelerated by the electric field, but toward stop detector 16, where the ionized atom or molecule is detected at time, $t_2$. The time-of-flight of the secondary electron from the ionization event to the start detection is much shorter than the time-of-flight of the ion from the ionization event to the stop detector, so the difference in times, $t_2-t_1$, corresponds to the time-of-flight of the ionized atom or molecule over the distance that it travels from the time it was ionized to the time it is detected at stop detector 16.

An ionized sample atom or molecule is considered to be initially at rest in the z direction if its initial energy in the z-direction is much less than the energy to which the ion is accelerated in drift region 12. It is well known to those having skill in this art, that the mean kinetic energy of a gaseous atom or molecule is 1.5 kT, where k is the Boltzman constant, and T is the temperature of the gas. At room temperature (approximately 300 K), the mean energy is approximately 0.04 eV. Therefore, an ionized sample atom or molecule can be at rest if the energy to which it is accelerated by the linear electric field in drift region 12 is much greater approximately 0.04 eV. For example, a typical acceleration by the electric field would be several kilovolts, so an ion can be considered to initially at rest.

Figure 2:
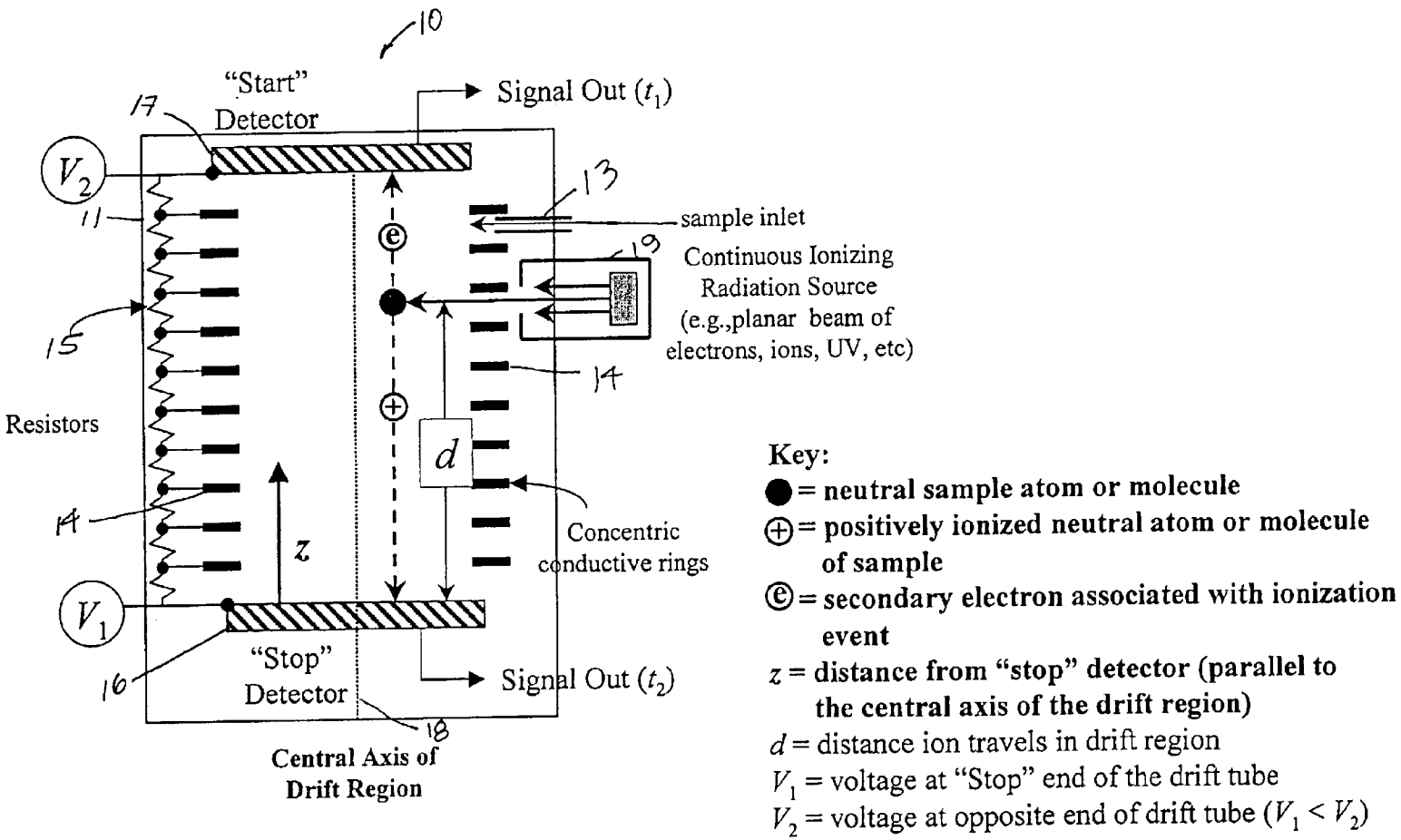
FIG. 2 is a schematic illustration of another embodiment of the present invention in which one method of introducing a linear electric field.

Another embodiment of the present invention utilizes an electric field that linearly increases in magnitude along the z-axis in drift region 12 from stop detector 16 to start detector 17, as is shown in FIG. 2. In this embodiment, the electric field is defined by $\epsilon(z)=kz$, where k is a constant that depends only on the electromechanical configuration of drift region 12. Assuming that a sample ion starts from a rest condition in drift region 12, the solution of Equation 12 using this electric field will yield the time-of-flight (and therefore the mass-per-charge) of a sample ion that is independent of the distance of travel, d, of the sample ion in drift region 12. This eliminates the requirement that continuous ionizing radiation source 19 emit ionizing radiation that is confined to a plane perpendicular to the z-axis, and allows the ionizing radiation to be spatially broad in the z-direction.

In this embodiment of the present invention, concentric electrically conductive rings 14 surround drift region 12, and are connected to resistors 15 that are connected between voltage $V_1$ and voltage $V_2$, as shown, again with $V_1$ negative with respect to $V_2$. Also as shown, $V_1$ is connected to stop detector 16, and $V_2$ is connected to start detector 17 at the opposite end of drift region 12. This arrangement provides the electric field in drift region 12 that is required by this embodiment of the present invention. The values of resistors 15 are selected to generate the linear electric field along the central axis of drift region 12. Generally, the values of resistors 15 increase quadratically from stop detector 16 ($V_1$) to start detector 17 ($V_2$) for the case of a cylindrical drift region 12.

The electric field created by $V_1$ and $V_2$ across resistors 15 and concentric rings 14 is coaxial about central axis 18 (the z axis), and has a magnitude, $\epsilon(z)$, normal to stop detector 16, as shown in U.S. Pat. No. 5,168,158, issued December, 1992, to McComas et al. Although concentric rings 14 and resistors 15 effectively provide the electric field for this embodiment of the present invention using a linear electric field, other methods can be used. For example, a dielectric cylinder could surround drift region 12, and have a resistive coating applied whose resistance varies with the distance from stop detector 16. Another electric field arrangement could involve appropriately shaped grids at stop detector 16 ($V_1$) and at start detector 17 ($V_2$) (see D. C. Hamilton et al., New high resolution electrostatic ion mass analyzer using time-of flight, Rev. Sci. Instrum. Vol. 61 (1990) 3104–3106). It is also possible that combinations of these methods could be used. Any method of effectively producing, in this embodiment, a linear electric field within drift region 12 could be used with this embodiment of the present invention.

Figure 3:
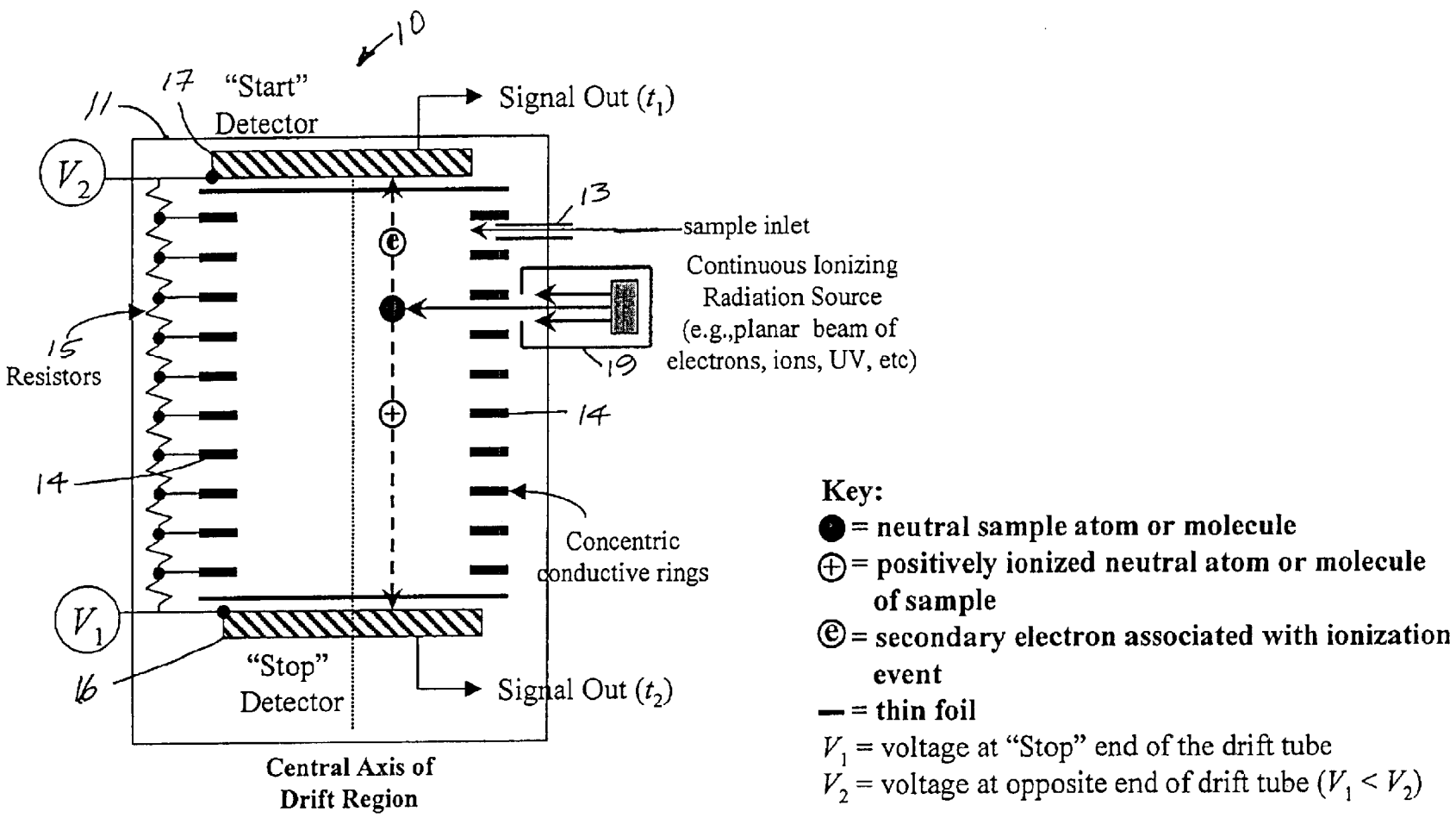
FIG. 3 is a schematic illustration of still another embodiment of the present invention in which a thin foil is installed at each end of the drift region.

Another embodiment of the present invention is illustrated in FIG. 3, where thin foils 16*a* and 17*a* are shown in place in front of stop detector 16 and start detector 17, respectively. Ions and secondary electrons associated with the ionization event pass through foils 16*a*, and 17*a* to stop detector 16 and to start detector 17. Thin foils 16*a*, 17*a* allow the pressure in drift region 12 to be maintained at a higher level than the operating pressure of start detector 16 and stop detector 17. This pressure differential also allows a greater amount of sample atoms or molecules in drift region 12, providing a higher ionization probability per ionizing radiation particle from continuous ionization radiation source 19. It should be noted, however, that the output of sample inlet 13 must be sufficiently low so that the inverse of the ionization rate, which equals the average time between discrete ionization events, is much longer than the time-of-flight of sample ions in drift region 12 in order to reduce the ambiguity introduced from multiple signals from start detector 17 or stop detector 16 when two or more ions are ionized nearly simultaneously.

Figure 4:
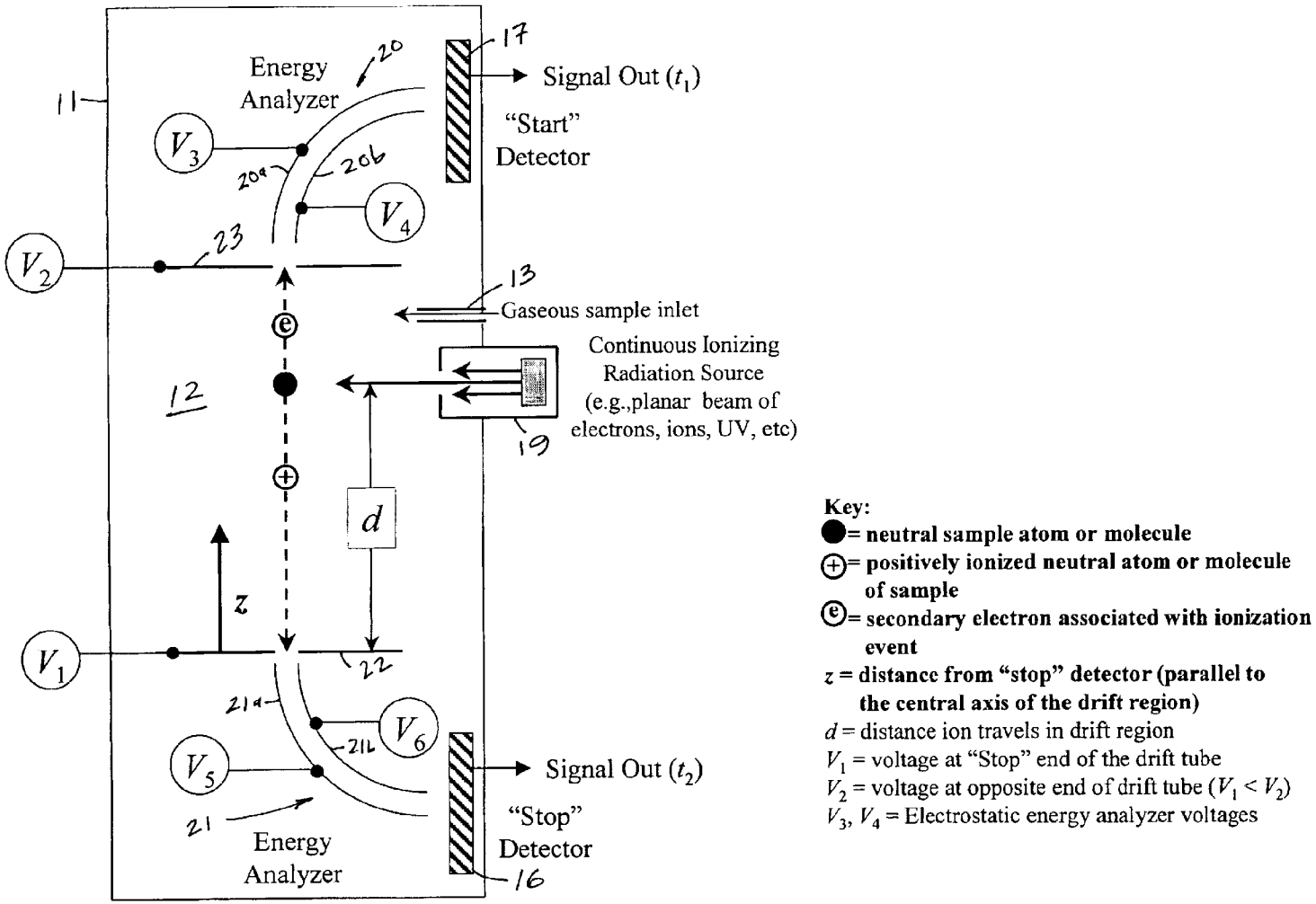
FIG. 4 is a schematic illustration of still another embodiment of the present invention in which the energy of the secondary electron and the energy of the ion are measured.

Another embodiment of the present invention is illustrated in FIG. 4. In this embodiment, the energy of a secondary electron is measured using electrostatic energy analyzer 20. Since an ion and its secondary electron are formed initially at rest, or nearly at rest, and are accelerated through a known electric field, the energy of the electron at start detector 17, and the energy of the ion at stop detector 16 each provide information of the distance in the z-direction that the initial ionization event occurred. Therefore, measurement of the energy of the secondary electron, the energy of the ion, or both the energy of the electron and the energy of the ion allows determination of the distance of travel, d, of the ion from its formation to stop detector 16. Measurement of the electron energy is the preferred embodiment because the time for an electron to traverse the additional path length required for energy measurement is much shorter than, and therefore insignificant relative to, the time-of-flight of the ion.

Measurement of the energy of an ion or electron by electrostatic energy analyzer 20 may be performed by means of a deflector-type electrostatic analyzer or mirror-type electrostatic analyzer {see D. Roy and R. P. Harkness, Reports on Progress in Physics, Vol. 53 (1990) p. 1621} and located as shown near start detector 17. To represent electrostatic energy analyzer 20 in FIG. 4, curvilinear plates 20*a*, 20*b* are shown connected to biasing voltages $V_3$ and $V_4$. If desired, another electrostatic energy analyzer 21 can be located near stop detector 16. As shown, curvilinear plates 21*a*, 21*b* connected to biasing voltages $V_5$ and $V_6$. According to the desired application of the present invention, either electrostatic energy analyzer 20 or electrostatic energy analyzer 21 could be used singly, or both electrostatic energy analyzer 20 and electrostatic energy analyzer 21 can be used together.

In this embodiment, it is necessary to connect voltages $V_1$ and $V_2$ to electrodes 22 and 23, which define an aperture to allow secondary electrons and sample ions to pass through. One important advantage of this embodiment is that the ionizing radiation from continuous ionizing radiation source 19 can be spatially broad in the z-direction.

For all embodiments of the present invention, stop detector 16 and start detector 17 can be any effective single particle detectors that can measure the time the sample ion strikes stop detector 16, and the secondary electron strikes start detector 17 with time accuracy much less the ion's TOF in drift region 12. Appropriate detectors for stop detector 16 and start detector 17 include microchannel plate detectors or channel electron multiplier detectors that would detect ionized sample atoms or molecules and secondary electrons that have been accelerated through drift region 12, and output a signal indicating that detection.

Continuous ionizing radiation source 19 emits continuous ionizing radiation into drift region 12 where it ionizes atoms or molecules of the gas sample of interest. Continuous ionizing radiation source 19 can emit any effective ionizing radiation, such as photons, electrons, or ions, and could be a laser, a source of electrons, or a source of ions.

Those with skill in this art recognize that the invention requires a power supply to provide the necessary potential differences required for $V_1$ and $V_2$, where $V_2$ is biased negatively with respect to $V_1$, to produce the necessary electric field, and to power pulsed ionizing radiation source 19. Additionally, power is required to be provided for the operation of stop detector 16 and start detector 17.

As has been explained, the present invention ionizes the sample atoms or molecules inside drift region 12, not in some external ion source. This allows the invention to be inherently compact, allowing the invention to provide TOFMS apparatus that has a small volume and mass, and that requires reduced power resources. The ionization of sample atoms or molecules inside drift region 12 also allows the present invention to accelerate the ions from a condition of near rest independent of the ion's position within drift region 12. This allows, in one embodiment, use of a spatially broad continuous ionizing radiation source 19 that is efficient and requires little or no steering, collimation or focusing.

In the present invention, the sample ion is formed when the sample atom or molecule is approximately at rest, and the time-of-flight of the sample ion in drift region 12, in one embodiment, is independent of the location at which the sample ion was formed. Therefore, the mass resolving power of the sample ion is dependent only on the initial ion energy relative to the energy to which it is accelerated and the accuracy of the time-of-flight measurement, which includes, for example, the timing accuracy of the time-of-flight measurement electronics.

The present invention requires only a small volume of sample material because most ions from sample atoms or molecules are detected. This is in contrast to prior art mass spectrometers, where few ions are extracted from the ion source to form an ion beam or ions that are extracted from the ion source and comprise the ion beam are removed from the ion beam by, among other things, collimating slits, and while the gate is "closed." Additionally, due to the smaller volume of the present invention, the pumping requirements for evacuation of evacuated chamber 11 is reduced, allowing use of a smaller vacuum pump.

Finally, the present invention requires lower voltage differences across drift region 12. Since a sample atom or molecule is ionized while it is at thermal energies of approximately 0.04 eV at 300 K, the calculated mass-per-charge of the ion is dependent on knowledge accuracy of the ion's energy relative to its accelerated energy as it traverses drift region 12. Because the spread in the initial energies of the sample ions is small, the acceleration voltage ($V_1-V_2$) does not have to be high. To put this into perspective, it should be noted that prior art linear ion mass spectrometers have energy spreads that typically range from 2 eV to 40 eV, which requires acceleration of the sample ions to a high energy in order to remove the uncertainty of the energies of the sample ions. In one embodiment of the present invention, a single applied voltage (except for the signal electronics) could be applied both as the bias for stop detector 16 and start detector 17 and for the voltage $V_1-V_2$ between stop detector 16 and start detector 17.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A time-of-flight ion mass spectrometer comprising:

an evacuated enclosure;

means for generating an electric field located in said evacuated enclosure;

means for injecting a sample material into said electric field;

a source of continuous ionizing radiation injecting ionizing radiation into said electric field to ionize atoms or molecules of said sample material; and timing means for determining time elapsed between arrival of a secondary electron having a particular energy out of said ionized atoms or molecules at a first predetermined location and arrival of a sample ion having a particular energy out of said ionized atoms or molecules at a second predetermined location.

2. The time-of-flight ion mass spectrometer as described in claim 1 wherein said source of continuous ionizing radiation emits electrons.

3. The time-of-flight ion mass spectrometer as described in claim 1 wherein said source of continuous ionizing radiation emits ions.

4. The time-of-flight ion mass spectrometer as described in claim 1 wherein said source of continuous ionizing radiation emits photons.

5. The time-of-flight ion mass spectrometer as described in claim 1 wherein said means for injecting a sample injects a gas sample into said linear electric field.

6. The time-of-flight ion mass spectrometer as described in claim 1, wherein said means for injecting a sample injects a solid sample into said linear electric field.

7. The time-of-flight ion mass spectrometer as described in claim 1 wherein said means for determining time elapsed comprises a timing circuit capable of starting timing upon arrival of said secondary electron at said first predetermined location, and stopping timing upon arrival of said sample ion at said second predetermined location.

8. The time-of-flight ion mass spectrometer as described in claim 7, wherein said timing circuit starts timing upon receipt of a signal from a microchannel plate detector.

9. The time-of-flight ion mass spectrometer as described in claim 7, wherein said timing circuit starts timing upon receipt of a signal from a channel electron multiplier.

10. The time-of-flight ion mass spectrometer as described in claim 7, wherein said timing circuit stops timing upon receipt of a signal from a microchannel plate detector.

11. The time-of-flight ion mass spectrometer as described in claim 7, wherein said timing circuit stops timing upon receipt of a signal from a channel electron multiplier.

12. The time-of-flight ion mass spectrometer as described in claim 1, further comprising a thin foil sheet over said first predetermined location and over said second predetermined location.

13. The time-of-flight ion mass spectrometer as described in claim 1, wherein said means for generating a continuous electric field comprises a first voltage, $V_1$, connected to said first predetermined location, and a second voltage, $V_2$, connected to said second predetermined location, where $V_2>V_1$.

14. The time-of-flight ion mass spectrometer as described in claim 1 wherein said means for generating a continuous electric field comprises a plurality of concentric electrically conductive rings including a first electrically conductive ring connected to said first predetermined location and a last electrically conductive ring connected to said second predetermined location, each adjacent electrically conductive ring being separated by a resistance, with voltage $V_1$ connected through a first resistance to said first electrically conductive ring and voltage $V_2$ connected through a second resistance to said last electrically conductive ring, where $V_2>V_1$.

15. The time-of-flight ion mass spectrometer as described in claim 14 wherein said continuous electric field varies linearly with distance from said second predetermined location to said first predetermined location and wherein resistance values of said resistance between said conductive rings increase quadratically with distance from second predetermined location.

16. The time-of-flight ion mass spectrometer as described in claim 1 further comprising energy measurement means located in said evacuated enclosure adjacent to said first predetermined location for measuring said particular energy of said secondary electrons.

17. The time-of-flight ion mass spectrometer as described in claim 16, wherein said energy measurement means is a pair of electrostatic deflection plates biased to different voltages, $V_3$ and $V_4$.

18. The time-of-flight ion mass spectrometer as described in claim 1 further comprising energy measurement means located in said evacuated enclosure adjacent to said second predetermined location for measuring said particular energy of said sample ions.

19. The time-of-flight ion mass spectrometer as described in claim 18, wherein said energy measurement means is a pair of electrostatic deflection plates biased to different voltages, $V_5$ and $V_6$.

20. The time-of-flight ion mass spectrometer as described in claim 1, further comprising first energy measurement means located in said evacuated enclosure adjacent to said first predetermined location for measuring said particular energy of said secondary electrons and second energy measurement means located in said evacuated enclosure adjacent to said second predetermined location for measuring said particular energy of said sample ions.

21. The time-of-flight ion mass spectrometer as described in claim 20, wherein said first energy measurement means and said second energy measurement means are each comprised of a pair of electrostatic deflection plates biased to different voltages, wherein said pair of electrostatic deflection plates of said first energy measurement means are biased to $V_3$ and $V_4$, and said pair of electrostatic deflection plates of said second energy measurement means are biased to $V_5$ and $V_6$.

* * * * *